United States Patent [19]

Schultz

[11] Patent Number: 4,942,985

[45] Date of Patent: Jul. 24, 1990

[54] 360 DEGREE VALVE FOR ATOMIZING PUMP DISPENSER

[75] Inventor: Robert S. Schultz, Old Greenwich, Conn.

[73] Assignee: Emson Research Inc., Bridgeport, Conn.

[21] Appl. No.: 305,288

[22] Filed: Feb. 2, 1989

[51] Int. Cl.[5] ..... B67D 5/40

[52] U.S. Cl. ..... 222/376; 222/402.19; 222/464; 222/481

[58] Field of Search ..... 137/212, 588; 222/402.19, 464, 376, 402.16, 481, 478

[56] References Cited

U.S. PATENT DOCUMENTS 2,968,428 1/1961 Samuel ..... 222/402.19
4,572,406 2/1986 Pratt et al. ..... 222/464
4,775,079 10/1988 Grothoff ..... 222/376

FOREIGN PATENT DOCUMENTS 3045565 6/1982 Fed. Rep. of Germany ..... 222/376
2058229 4/1981 United Kingdom ..... 222/402.16

*Primary Examiner*—H. Grant Skaggs
*Attorney, Agent, or Firm*—Kenyon & Kenyon

[57] ABSTRACT

A 360° valve body for use with a dispenser includes a lower section of generally cylindrical shape containing therein a central first bore for accepting a dip tube and a top, an upper section of generally cylindrical shape but of smaller diameter than the first section extending from the top, with the upper section having a central second bore therein, the first bore and second bore having a common axis, with the upper section adapted to be inserted into a dispenser. A third bore is formed in the top of the bottom part adjacent the upper section and extends to first bore in the lower section and has therein a seat for a ball check valve. An arcuate recess formed in a portion of said upper part adjacent opening is used for guiding a ball at one point and first and second posts, each having an arcuate inner surface, spaced from each other and the arcuate cutout are used for guiding said ball at two other points.

6 Claims, 4 Drawing Sheets

FIB.7b

360 DEGREE VALVE FOR ATOMIZING PUMP DISPENSER

Background of the Invention

This invention relates to atomizing pump dispensers in general and more particularly to improvements in a valve which allows atomizing pump dispensers to operate in any orientation including an upside-down orientiation.

Typical atomizing pump dispensers include a pump chamber or cylinder in which a piston reciprocates. The inner end of the cylinder contains a check valve which permits fluid to refill the cylinder on the return stroke of the piston after fluid has been pumped out through an atomizer. Typically, the pump inlet is coupled to a dip tube which extends to the bottom of the container from which the fluid is being dispensed. This type of assembly assumes that the pump will be operated from an upright position. There are other pumps designed to be operated in an upside-down position where the inlet to the pump chamber does not contain a dip tube. It is assumed that these pumps will be operated in an upside-down condition where the fluid will be at the top of the container and flow in to refill the pump chamber after dispensing. In the case of the normal dispenser, if it is turned upside-down, the dip tube is no longer in the fluid and dispensing will not take place. Similarly, if the dispenser is designed for upside-down operation, the pump inlet will not be submerged in the fluid to be dispensed when the dispenser is upright.

It has been recognized that there are certain types of materials which when being used may require the container to take various positions, from upright to upside-down. An example might be a spray, such as insect repellent, applied to the body. If applied, for example, to the arms, the pump would be held upright by the person applying. However, when applied to the back or back of the neck, the normal position of the hand when dispensing would cause the container to be upside-down.

Thus, dispensers have been developed to permit doing this. An example of a such a prior art attachment for a dispenser is shown in FIGS. 1–3. FIG. 1 is a cross sectional view and FIG. 2 a plan view of this pump attachment which permits dispensing from any orientation. Shown is a body member 11 which includes an upper hollow cylindrical part 13 with a passageway 14 and a lower cylindrical part 15. Upper cylindrical part 13 has a tapered end 17 and is adapted to be inserted into a pump instead of a dip tube. Lower part 15 contains beads 19 on its inner surface to permit the frictional insert of a dip tube to provide a path for fluid in a container to reach passageway 14 and, from there, a pump chamber. The diameter of cylindrical portion 15 is substantially greater than that of the diameter of cylindrical part 13. Cylindrical part 13 is located, as can be seen from FIG. 2, such that its axis 21 is displaced from the axis 23 of cylindrical part 15. In order to permit filling a pump into which the arrangement of FIGS. 1–3 is inserted from an upside-down position, another inlet is provided into the space 25 within the cylinder 15. This inlet 27 is a valved inlet. At the inlet, a valve seat 29 is formed. Extending from the valve seat are three flexible prongs, 31, 32 and 33. Contained within the space defined by the three prongs 31–33, is a ball 35 (shown only in FIG. 3) which, when the pump is upright, is seated on seat 29 as shown in FIG. 3. This ensures that the fluid to be dispensed is drawn through the dip tube, which will be inserted within the recess 25 of cylinder 15, rather than drawing air through the inlet 27. On the other hand, when the pump is turned upside-down, the ball will move to the position shown in dotted lines in FIG. 3 opening up passage 27 so that fluid can flow into the interior of the cylinder 15 and thus into the interior 14 of cylinder 17.

This has provided a solution to the problem of dispensing from any orientation. However, the design shown in FIGS. 1–3 has caused problems in assembly and reliability. Because of the fact that the axis 21 is offset from the axis 23, assembly is difficult. That is to say, in assembling, a rotational location is necessary to make sure that, when assembling the cylinder 13 to a pump, it is properly aligned. In addition, the construction of the prongs 31–33 has resulted in breakage during shipping and assembly. There have also been problems with the ball falling out and with the dip tube coming loose. This last problem is thought to be related to the fact that the dip tube is off center.

In view of these problems with this prior art design, the need for a better design is apparent.

Summary of the Invention

The present invention fills this need. In the design of the present invention, the cylindrical portion which is inserted into the pump has its axis on the same center line as the cylindrical portion which receives the dip tube. This greatly eases automatic assembly and results in up to a five to one reduction in cost. Furthermore, rather than using three prongs to retain the ball, two posts are used along with a recess in the outer surface of the cylindrical part which inserts into the pump. This is a much stronger arrangement, and avoids breakage of the posts. The two posts have only small projections on their undercuts, enough to hold the ball in place. The design is such that once the valve assembly is assembled onto the pump, the bottom of the pump is able to act to retain the ball in place. Thus, the problem with the prior art assembly, in which the ball tended to fall out, is not present in the present invention. Adjacent the post and extending from one post to the other, concentric with the cylindrical member which inserts into the pump, is a partially annular wall. This wall has two vertical edges spaced from the respective posts. The posts have a heighth which is less than the heighth of this partially annular wall. As a result, this arrangement forms a flat which is helpful in automatic assembly. In addition, there are provided ribs extending between the upper cylindrical portion which inserts into the pump and the partially annular wall. These ribs keep the assembly from twisting and tilting.

In accordance with the design of the present invention, it is necessary that the ball motion be approximately equal to its diameter because of the Venturi effect which tends to pull the ball onto its seat when dispensing. Furthermore, when dispensing viscous materials, it is important that the inlet at the ball valve be as close as possible to the inlet to the inner portion of the cylindrical part inserted into the pump.

Also disclosed is a mold and a method of molding the valve assembly. In the method of molding, all of the critical dimensions are on one pin.

Brief Description of the Drawings

FIG. 7*b* is a front view of the upstanding portion of the post of FIG. 7.

Detailed Description

Figure 2:
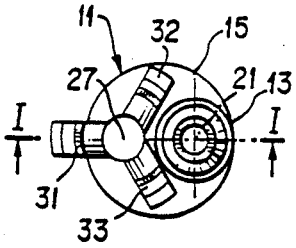
FIG. 2 PRIOR ART
FIG. 2 is a plan view of the valve of FIG. 1.
Figure 3:
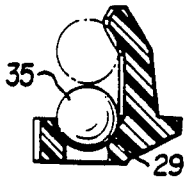
FIG. 3 PRIOR ART
FIG. 3 is a sectional view illustrating the operation of the ball check valve associated with the valve of FIGS. 1–2.
Figure 1:
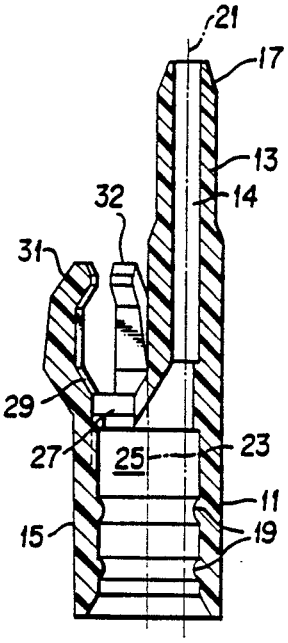
FIG. 1 PRIOR ART
FIG. 1 is a cross sectional view of a prior art 360° valve.
Figure 4:
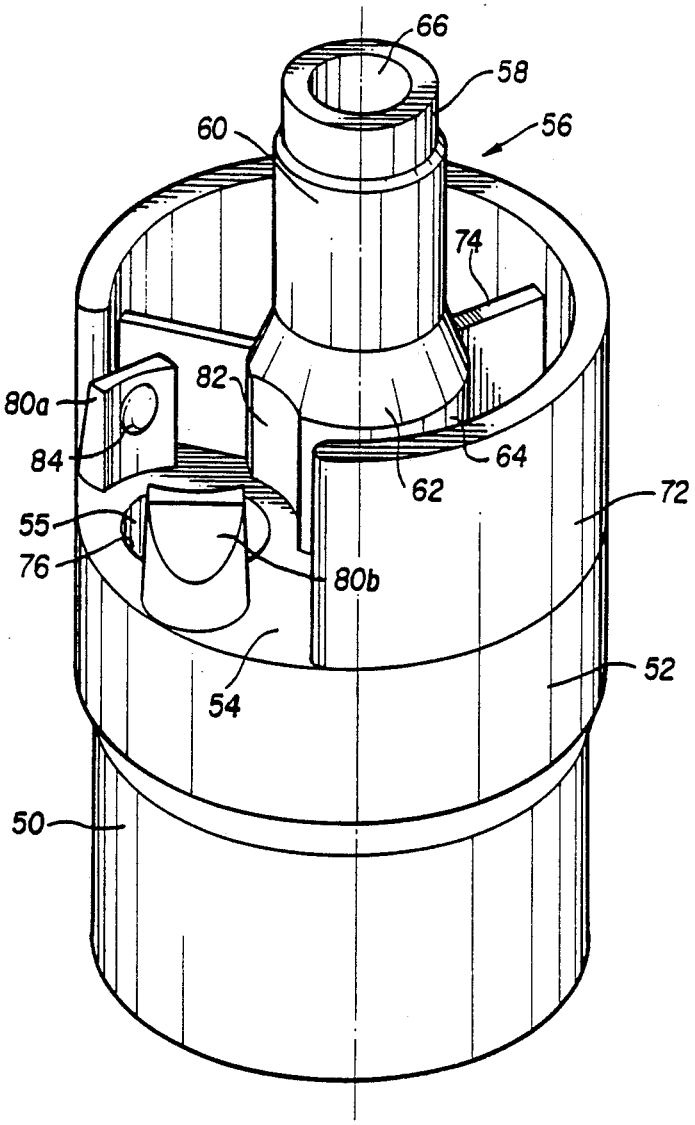
FIG. 4 is a perspective view of 360° valve of the present invention.

As illustrated in FIG. 4, the valve of the present invention includes a valve body with a lower cylindrical portion 50, an intermediate generally cylindrical portion 52 and an upper portion 56, which includes a first cylindrical section 58, a second cylindrical section 60 of slightly greater diameter, a frustro conical portion 62, and a third section 64 of cylindrical shape.

Figure 5:
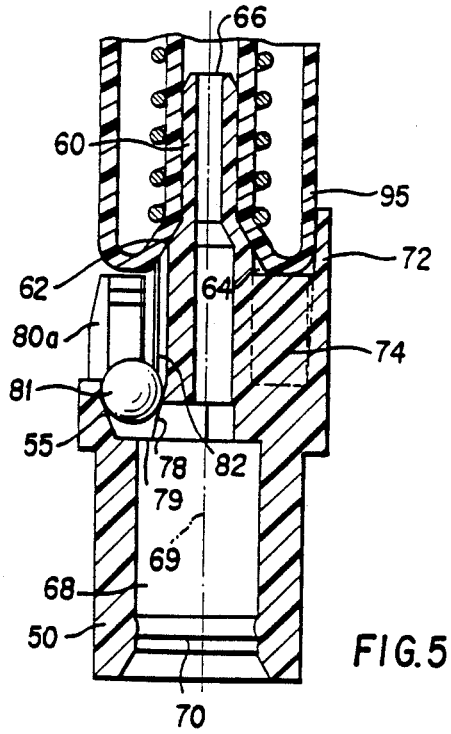
FIG. 5 is a cross sectional view of the valve of FIG. 4 mounted to the bottom of a pump.

As can be seen from the cross sectional view of FIG. 5, there is a central passageway 66 through the upper portion 56, which is in communication with a central space or cylindrical bore 68 inside the cylindrical portion 50. The cylindrical bore 68 within portion 50 contains, on its inner side, a projecting bead 70, so as to tightly hold a dip tube, which is inserted into the recess 68, in place. The lower part 50 and cylindrical recess 68 have a common axis 69 with the upper part 58 and its passageway 66. As noted, this provides a significant improvement over the prior art, in that it permits easier molding.

On top of the intermediate portion 58, a partially annular wall 72 is formed partially surrounding the upper portion 56. Three ribs 74 are provided for strengthening purposes, extending between the portion 64 and the outer wall 72. In the area on top of the intermediate section 52, adjacent to flat portion 54, the seat 55 for a ball check valve is formed. This is formed by a bore 76 which terminates in a frustro conical cross section 78.

Figure 7A:
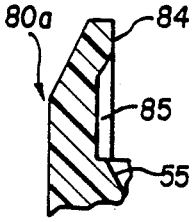
FIG. 7*a* is a cross sectional view along section VII—VII of FIG. 6.

Unlike the arrangement of the prior art in which three flexible prongs were provided, in accordance with the present invention, a ball is guided between two posts 80*a* and 80*b*, with the third guiding surface provided by an arcuate cutout 82 in the lower portion 64 of the upper part of the valve body. In order to retain the ball in place and keep it from falling out, a small bump or projection 84 (see FIGS. 7*a* and 7*b*) is formed on each of the posts 80*a* and 80*b*. The projections are only large enough to hold the ball in place temporarily. The primary way in which the ball is prevented from coming out from the space formed by the two posts 80*a* and 80*b* and the arcuate cutout 82, is by means of the bottom of the pump 95 with which the valve is used. The valve is shown inserted, in place of a dip tube in a pump 95, such as the pump disclosed in U.S. Pat. No. 4,230,242. It can be seen that as the upper portion 56 is inserted into pump 95, the tops of the two posts 80*a* and 80*b* will come in close proximity to or into contact with the bottom of the pump, as will the ribs 74, with the extreme outer portion of the wall 72 surrounding the lower end of the pump housing.

The opening 79 from the valve seat 78 into the outlet passage 66 is a very short distance in order to prevent problems when viscous liquids are being drawn into the pump. For similar reasons, and to provide proper operation so as to prevent the Venturi effect from seating the ball 81, the amount of travel of the ball between its seated position and its fully upward position is approximately equal to the ball diameter.

As noted previously, because of the axial alignment, it is less likely that the dip tube will come loose, in addition to the big advantage of automatic assembly, since all parts can be kept in a straight line, i.e., the pump, the valve of the present invention, and the dip tube. It is also noted that the tops of the two posts, 80*a* and 80*b*, are flat and are lower than the top of the wall 72. Thus, it is possible by means of the tops of the two posts 80*a* and 80*b* and the edges 85 of the wall 72 to carry out a locating operation. This provides for a good lead-in during assembly. As noted previously, the ribs 74 provided added strength and prevent twisting and tilting.

Figure 6:
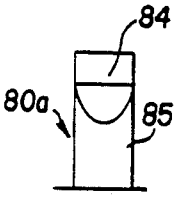
FIG. 6 is a plan view of the valve of FIG. 4.
Figure 6:
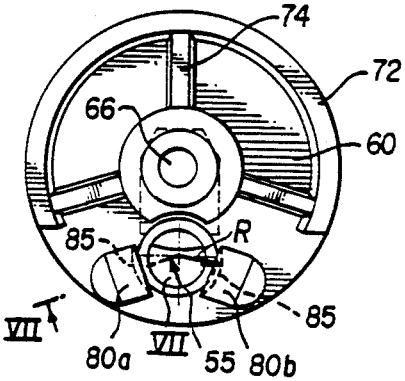

As illustrated by FIG. 6, the posts each have a portion of a radius R, shown in dotted lines, which forms a channel for the ball. The cross sectional view of 7*a* shows the shape of the post and the channel 85 which is in the lower part of the post, extending to the area of the valve seat 55. Also shown, is the projection 84 at the top of the post, which retains the ball in place. FIG. 7*b* is a front view showing the shape in the area of the projection 84.

Figure 8:
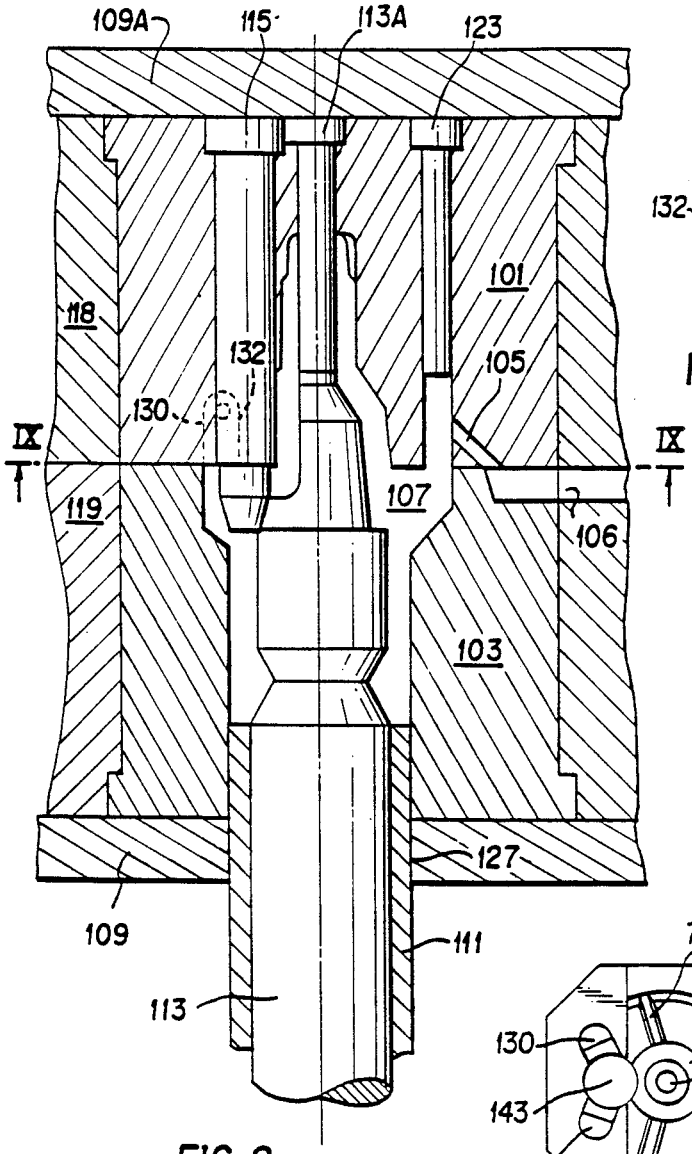
FIG. 8 is a cross sectional view of a mold for making the valve of FIG. 4–7.

FIG. 8 illustrates a mold design which provides a particularly simple way of molding the valve body for the upside-down pump valve of the present invention. Shown is a top mold cavity 101 and a bottom mold cavity 103. These two mold cavities, along with a core pin 113 and 113A and a pin 115 define the cavity 107 into which plastic is supplied through the inlet 105 and gate 106. Also provided are two vent pins 123 (only one of which is visible), for venting the mold in conventional fashion. Pin 113 is inserted from the bottom, and pin 113A from the top. The two mold cavities 101 and 103 are held in plates 118 and 119 by back up plates 109 and 109A. A cylindrical opening 127 is formed in plate 109 and a knock out sleeve 111 surrounds pin 113 with the pin 113 and knock out sleeve 111 extending through the opening 127 into the mold cavity.

The disclosed arrangement permits forming even the valve seat and the two posts using straight through molding techniques. This is accomplished by forming each of the posts using a recess 130 in the upper mold part 101 which cooperates with the pin 115. In addition to this recess, the pin contains two further recesses 132 to form the projections 84 which retain the ball in place. Because of the shallowness of this projection, withdrawal of the pin past the projection is possible.

Figure 10:
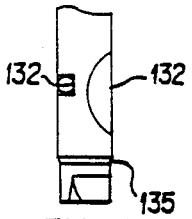
FIG. 10 is a side view of a pin used in the present invention.

FIG. 10 is a view of the end of pin 115. The surface 135, which forms the ball seat is visible, as are two recesses 132, which are used to form the projection 84 at the end of each of the posts. In effect, what this means is that all of the critical dimensions are contained on this mold pin, giving good control over these critical dimensions.

Figure 9:
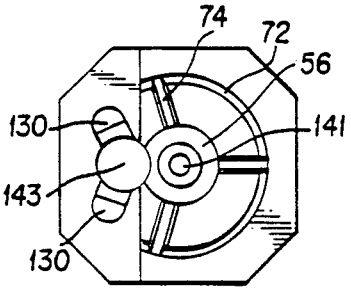
FIG. 9 is a plan view of a portion of the mold of FIG. 8.

FIG. 9 is a view looking into the upper mold cavity 101. The mold includes recesses 130, which form the outer surface of the posts shown in FIG. 7*b*. Also seen in this view are the openings in the mold for forming the wall 72, ribs 74 and the upper portion 56. The opening 141, through which pin 113*a* is inserted is visible, as is the opening 143, through which pin 115 is inserted.

The 360° or upside-down valve has been disclosed as a valve for use with a pump dispenser. It should be noted that such a valve can also be used at the inlet of a dispenser having a dispensing valve used in a pressurized atomizing dispenser in which the dispensing pressure is created by a gas stored under pressure rather than by the pumping effect of the operator's finger.

What is claimed is:

1. A 360° valve body for use with a dispenser comprising:

(a) a lower section of generally cylindrical shape containing therein a central first bore for accepting a dip tube and having a top;

(b) an upper section of generally cylindrical shape but of smaller diameter than said lower section extending from said top, said upper section having a central second bore therein, said first bore and said second bore having a common axis, said upper section adapted to be inserted into a dispenser (c) a third bore in the top of said lower section adjacent said upper section and extending to said first bore in said lower section and having therein a seat for a ball check valve;

(d) an arcuate recess formed in a portion of said upper section adjacent said third bore for guiding a ball at one point;

(e) first and second posts, each having an arcuate inner surface, spaced from each other and said arcuate recess for guiding said ball at two other points;

(f) projections on said first and second posts to aid in retaining a ball in place above said seat; and (g) a partially annular wall partially surrounding said upper section, said wall having first and second ends adjacent and spaced from said posts.

2. A valve body according to claim 1 and further including ribs extending between said wall and said upper section.

3. A valve body according to claim 1 wherein the tops of said posts are flat and wherein the height of said posts is less than the height of said wall whereby a flat useful for guiding purposes is formed.

4. A valve body according to claim 1 wherein said third bore terminates in a frustro-conical cross section forming a seat for said ball.

5. A valve body according to claim 1 wherein said lower section includes a lower portion of a first outer diameter and an intermediate portion of a larger diameter, said top formed on said intermediate portion.

6. A valve body according to claim 1 wherein said upper section comprises an inner part of first diameter extending from said top, said arcuate recess formed in said inner part;

a frustro-conical part extending from said inner part; and a further part of smaller diameter than said inner part extending outwardly from said frustro-conical part.

* * * * *